United States Patent [19]

Krupey

[11] 4,295,280

[45] Oct. 20, 1981

[54] METHOD OF OBTAINING A LYOPHILIZED PRODUCT

[75] Inventor: John Krupey, Montreal, Canada

[73] Assignee: American Home Products Corporation, New York, N.Y.

[21] Appl. No.: 130,927

[22] Filed: Mar. 17, 1980

[51] Int. Cl.[3] ..... F26B 5/06

[52] U.S. Cl. ..... 34/5; 62/60

[58] Field of Search ..... 34/5, 92; 62/60, 78

[56] References Cited

U.S. PATENT DOCUMENTS

| | | | |
|---|---|---|---|
| 2,803,888 | 8/1957 | Cerletti | 34/5 |
| 3,269,905 | 8/1966 | Damaskus et al. | 167/58 |
| 3,579,360 | 5/1971 | Rey et al. | 34/5 |
| 3,616,543 | 11/1971 | Barclay | 34/5 |
| 3,862,302 | 1/1975 | Price et al. | 424/12 |
| 3,932,943 | 1/1976 | Briggs et al. | 34/5 |
| 4,001,944 | 1/1977 | Williams | 34/5 |
| 4,060,911 | 12/1977 | Weiler et al. | 34/5 |
| 4,162,003 | 7/1979 | Bartos et al. | 34/5 |

*Primary Examiner*—John J. Camby

*Attorney, Agent, or Firm*—Adley F. Mandel

[57] ABSTRACT

A mixture of at least two liquid compositions, each having a material which is incompatible in the presence of moisture with a material in the other liquid composition, is cooled to a temperature slightly above its freezing point. The cooled mixture is charged into a container cooled substantially below the freezing point of the mixture so the mixture freezes instantly. The frozen mixture is lyophilized to provide a mass of dry matter.

6 Claims, No Drawings

METHOD OF OBTAINING A LYOPHILIZED PRODUCT

BACKGROUND OF THE INVENTION

This invention relates to a process for obtaining a package containing a mass of dry matter comprising at least two materials incompatible with each other in the presence of moisture. More specifically, this invention relates to a process of obtaining a multicomponent, lyophilized immunological reagent.

A problem exists in producing a dry mixture of two or more materials which are incompatible or react with each other in the presence of moisture. Exposure to conditions which allow the two materials to react must be minimized.

Various methods have been employed in the past to obtain a product containing at least two materials incompatible with each other in the presence of moisture.

In U.S. Pat. No. 3,269,905, granted on Aug. 30, 1966 to G. W. Damaskus, a method is described in which reagents that are incompatible with each other in the presence of moisture are subjected to freezing in successive layers in a container and thereafter the frozen strata is freeze-dried.

In U.S. Pat. No. 3,616,543, granted Nov. 2, 1971 to E. S. Barclay, a method is described in which reagents that are incompatible with each other in the presence of moisture are sequentially charged in liquid form into a container with freezing of the charge and rotation of the container between charges so that the separate charges to not touch, and then lyophilizing the frozen charges.

In U.S. Pat. No. 3,862,302, granted Jan. 21, 1975 to R. T. Price et al., a method is described in which reagents in solution are separately formed into frozen beads or spheres and then placed into a container for lyophilization.

A simple, quick process now has been found for producing a dry mixture of two or more such incompatible materials.

SUMMARY OF THE INVENTION

According to this invention, a process for obtaining a package containing a mass of dry matter, comprising at least two materials incompatible with each other in the presence of moisture, is realized by the steps of:

(a) preparing separate liquid compositions of each of the materials;

(b) cooling each of the liquid compositions to a temperature slightly above it freezing point;

(c) mixing the cooled liquid compositions to obtain a mixture thereof;

(d) charging the mixture of liquid compositions at a temperature slightly above the freezing point of the mixture into a container maintained at a temperature substantially below the freezing point of the mixture so that the mixture freezes in the container; and (e) lyophilizing the frozen mixture.

The mixture of liquid compositions is charged in such predetermined amounts that the mixture immediately freezes on the inner surface of the container.

DETAILS OF THE INVENTION

In one embodiment of the invention each of the two liquid compositions is cooled separately to 1° to 5° C. above its freezing point. The cooled liquid compositions are mixed and at a temperature of 1° to 5° C. above the freezing point of the mixture are charged directly into the bottom of an upright container, which is maintained at a temperature substantially below (e.g. 50° to 100° C. below) the freezing point of the mixture.

The precooled mixture can be used when the upright container is a receptacle with a small surface area or one which is shallow, such as found in multiwelled plates used for performing diagnostic assays. A specific example of such a receptable is the multiwelled plate sold under the trademark "Microtiter" and manufactured by Cooke Laboratory Products of Alexandria, Virginia. This plate contains a multiplicity (96) of shallow "vee" shaped wells or "u" shaped cupules, each well having a capacity of about 0.25 ml to 0.30 ml. Accordingly, this invention provides a method of obtaining a convenient and practical form of immunological reagents, for example, the immunological reagents used for detecting human chorionic gonadotropin (hCG), luteinizing hormone (LH), follicle stimulating hormone (FSH) or human menopausal gonadotropin. More specifically, a test plate suitable for performing immunologic reactions is provided, the test plate having at least one well of a capacity of about 0.1 to 1.0 ml., employing reagents which are incompatible with each other in the presence of moisture. In this instance, the steps (a) to (e) are performed with the mixture of incompatible reagents being charged at a temperature slightly above its freezing point in a volume equal to about 20 to 60% of the volume of the well. Subsequent freezing and lyophilization of the mixture of reagents in the well gives the test plate ready for use. For following the preceding procedure, technical problems (e.g. interaction of the reagents, spilling, excessive foaming, and the like), which are encountered when a mixture of reagents simply is added to the well, and the charged plates thereafter are subjected to freezing and lyophilizing conditions, are eliminated or minimized.

In a still further refinement of this latter embodiment, the ionic strength of the pre-lyophilized reagents is increased by a factor of 2 to 3, preferably 2.5, over the ionic strength of reagents usually used for immunological reagents when the mixture of immunological reagents is applied to a test plate having a plurality of shallow, small volume wells of about 0.2 to 0.3 ml.

The process of the invention can be illustrated with respect to reagents for an immunological or diagnostic test for detecting the presence of human chorionic gonadotrophin (hCG) in urine, which test is utilized in the diagnosis of pregnancy. Likewise, the process of this invention can be illustrated with respect to reagents for an immunological or diagnostic test for detecting the presence of luteinizing hormone (LH) in urine, which test is utilized in detecting ovulation in cycling women. In these instances, the liquid reagent compositions are aqueous.

An example of particular reagents that may be used for detecting hCG or LH are those described in copending patent application U.S. Ser. No. 806,563, filed June 14, 1977, and abandoned and U.S. Pat. No. 4,123,343, granted Oct. 31, 1978 to J. Krupey and E. F. Welchner, both said patent and application being herein incorporated by reference in their entirety. Corresponding patent application to the U.S. application are European Patent Application No. 102, published Dec. 20, 1978, and Japanese Patent Application No. 8719/1979, published Jan. 23, 1979, of M. A. Hirsch, D. S. Irvine and J. Krupey.

The preceding, particular reagents are characterized preferably by:

(1) pyruvic aldehyde stabilized erythrocytes sensitized to human chorionic gonadotropin with a bifunctional molecule selected from glutaraldehyde, glyoxal, succinicaldehyde, hexamethylene diisocyanate, toluene 2,4-diisocyanate and dimethyl suberimidate; and (2) a highly purified antiserum to human chorionic gonadotropin or the beta subunit thereof.

In a more preferred embodiment, the bifunctional molecule is selected from glutaraldehyde and hexamethylene diisocyanate, and said highly purified antiserum is adjusted to have a sensitivity to human chorionic gonadotropin of about 100–150 m.I.U. per test and a cross reactivity to other glycoprotein hormone antigens of less than 25%. In a still more preferred embodiment a highly purified antiserum with a cross reactivity to other glycoprotein hormone antigens of less than 0.05 to 0.1% is employed.

EXAMPLE 1

Pregnancy Test Reagents

Immunologic and antiserum compositions useful as reagents in hemagglutination inhibition tests for pregnancy were prepared. A liquid composition of stabilized hCG sensitized red blood cells was prepared by suspending the cells in a lyophilization medium which contained a suitable carbohydrate diluent, buffer, sodium chloride, normal rabbit serum, merthiolate and ethylenediaminetetracetic acid (EDTA). A liquid composition of antiserum in the same lyophilization medium was prepared. The amount of antiserum in the liquid composition was adjusted to give a predetermined test sensitivity. The two liquid compositions were cooled separately to a temperature of 2°–5° C. and then mixed. Immediately thereafter, 0.1 ml of the mixture was injected into the bottom of a round bottomed vial, siliconized on its inner surface and having an internal diameter of 12–16 mm, the round bottomed vial having been precooled in an acetone-dry ice bath at about −70° C. The mixture instantly froze. The frozen mixture of reagents was lyophilized immediately in a freeze dryer for 16–20 hours at about 75 to 100 micron Hg. The dried material performed as anticipated when tested for specific sensitivity to hCG.

EXAMPLE 2

Pregnancy Test Reagents

Each of the two liquid compositions, described in Example 1, were cooled to a temperature of 2°–4° C., mixed and immediately injected from an automatic pipette (0.1 ml aliquots) into the bottom of a series of wells contained in a multiwelled plate sold under the trademark "Microtiter", which had been precooled in a dry ice-isopropanol mixture. The mixture of the liquid compositions instantly froze. The plate containing the reagents was lyophilized in a freeze dryer for 16–20 hr at about 70 to 200 microns Hg. The plate in the freeze dryer rested on a dry ice, pre-cooled aluminum block. The dried materials performed as anticipated when tested for specified sensitivity to hCG.

EXAMPLE 3

Ovulation Test Reagents

(a) Preparation of first liquid composition

A suspension of stabilized, sensitized red blood cells (10% in normal saline containing 0.1% sodium azide as a preservative, see copending U.S. Patent Application Ser. No. 806,563, filed June 14, 1977) now abandoned was washed three times with a 0.15 M phosphate buffer solution (pH=7.0). The washed cells were resuspended as a 0.625% v/v suspension in a lyophilization buffer (pH 7.0), prepared from 25 g of sucrose, 25 ml of 1% merthiolate, 10 ml of normal rabbit serum (NRS, triply absorbed) and q.s. to 1 liter with 0.375 M phosphate buffer saline (PBS) containing EDTA, and EDTA being 0.125 M with respect to the PBS.

(b) Preparation of second liquid composition

A non-specific hCG or specific LH antiserum, prepared according to the procedure described in copending U.S. Patent Application Ser. No. 806,563, was diluted further with 0.15 M phosphate buffer saline (pH 7.0) containing 0.2% NRS (triply absorbed). The extent of dilution with the PBS was such that the proper concentration of antiserum was present in a 50 μl aliquot of the second reagent to give a predetermined test sensitivity with 50 μl aliquot of the first reagent.

These above liquid compositions may be stored at −100° C.

The first and second liquid compositions were each cooled separately to 2° to 5° C. and the cooled reagents were mixed. The cooled mixture (2 to 5° C.) was immediately injected from an automatic pipette (0.1 ml aliquots) into the bottom of a series of wells contained in a multiwelled plate sold under the trademark "Microtiter", which has been precooled in a dry ice-isopropanol mixture. The mixture instantly froze. The plate containing the reagents was lyophilized in a freeze dryer for 16–20 hr at about 70 to 200 microns Hg. The plate in the freeze dryer rested on an aluminum block precooled with dry ice. The dried materials performed as anticipated when tested for specified sensitivity to LH, after the reagents in each well were mixed with 0.25 ml of the urine to be tested.

By following the procedure of Example 3 but applying the cooled mixture to a round bottomed tube, siliconized on its inner surface instead of the "Microtiter" plate, the tube having been precooled in an acetone dry-ice bath at about −70° C., followed by immediately treating tube and mixture of reagents to the lyophilization procedure described in Example 1, a convenient and efficaceous preparation to the lyophilized immunological reagent also was obtained.

I claim:

1. A process for obtaining a package containing a mass of dry material comprising at least two immunologic reagent materials incompatible with each other in the presence of moisture comprising the steps of:

(a) preparing separate aqueous liquid compositions of each of the materials;

(b) cooling each of the liquid compositions to a temperature slightly above its freezing point;

(c) mixing the cooled liquid compositions to obtain a mixture thereof;

(d) charging the mixture of liquid compositions at a temperature slightly above the freezing point of the mixture into a container maintained at a temperature substantially below the freezing point of the mixture so that the mixture freezes in the container; and (e) lyophilizing the frozen mixture.

2. The process of claim 1 wherein each of the liquid compositions is cooled to a temperature of about 1° to 5°

C. above its freezing point and the mixture is charged at a temperature of about 1° to 5° C. above the freezing point of the mixture into the container.

3. The process of claim 1 wherein one liquid composition consists essentially of a predetermined immunologically effective amount of a suspension of sheep erythrocytes sensitized with human chorionic gonadotropin.

4. The process of claim 3 wherein a second liquid composition consists essentially of a predetermined immunologically effective amount of human chorionic gonadotropin antiserum together with phosphate buffer.

5. The process of claim 2 or 4 wherein the simultaneous charging of the liquid compositions is directed to the bottom of the upright container.

6. The process of claim 5 wherein the container is a shallow container.

* * * * *